US006046535A

United States Patent [19]

Jung

[11] Patent Number: 6,046,535

[45] Date of Patent: Apr. 4, 2000

[54] SHADOW MASK FRAME ASSEMBLY FOR A CATHODE RAY TUBE

[75] Inventor: Byung-Hwa Jung, Keumjung-gu, Rep. of Korea

[73] Assignee: Samsung Display Devices Co., Ltd., Rep. of Korea

[21] Appl. No.: 09/090,829

[22] Filed: Jun. 4, 1998

[30] Foreign Application Priority Data

| | | | |
|---|---|---|---|
| Jul. 30, 1997 | [KR] | Rep. of Korea | 97-20516 |
| Sep. 25, 1997 | [KR] | Rep. of Korea | 97-26539 |
| Sep. 25, 1997 | [KR] | Rep. of Korea | 97-26540 |

[51] Int. Cl.[7] ..... H01J 1/02

[52] U.S. Cl. ..... 313/402; 313/406; 313/407

[58] Field of Search ..... 313/402, 404, 313/406, 407

[56] References Cited

U.S. PATENT DOCUMENTS

| | | | |
|---|---|---|---|
| 5,763,990 | 6/1998 | Kwak | 313/402 |
| 5,793,156 | 8/1998 | Han et al. | 313/407 |
| 5,898,259 | 4/1999 | Reyal | 313/407 |

*Primary Examiner*—Ashok Patel

*Attorney, Agent, or Firm*—Baker & McKenzie

[57] ABSTRACT

The present invention discloses a shadow mask frame assembly for a cathode ray tube comprising a burring formed by bending the open end portion of the mask frame for improving the mechanical intensity of a mask frame, a groove portion formed on predetermined positions of the burring for easily mounting the mask frame inside the face panel without interference between the stud pin and the burring, and a planar perpendicular portion, which is formed on a lower portion of the burring, parallel to an axial direction of the cathode ray tube, to which a skirt portion of the shadow mask is welded.

6 Claims, 5 Drawing Sheets

SHADOW MASK FRAME ASSEMBLY FOR A CATHODE RAY TUBE

BACKGROUND OF THE INVENTION

1. Field of the Invention

The present invention relates to a shadow mask frame assembly for a cathode ray tube suitable for a shadow mask, and more particularly, it relates to a shadow mask frame assembly for a cathode ray tube for enlarging an useful screen and easily assembling and disassembling a shadow mask to a mask frame.

2. Description of the Prior Art

In a color cathode ray tube having a shadow mask, R, G, and B electron beams emitted from an electron gun are converged, passed through apertures of a shadow mask, and landed on R, G, and B phosphor, and thereby realizing colors.

The shadow mask is disposed in a position adjacent to a phosphor.

FIG. 3 shows a general structure of a conventional mask frame.

In FIG. 3, a shadow mask 1 comprises an approximately rectangle-shaped useful screen portion 5 having apertures 3 through which electron beam passes and a skirt portion 7 formed by approximately perpendicularly bending a border of the useful screen portion 5 having apertures 3.

Referring to FIG. 4, the skirt portion 7 of the shadow mask is welded inside a mask frame 9.

The mask frame assembly which the shadow mask 1 is welded inside dispose the shadow mask 1 at a predetermined space from a phosphor layer 17 coated on the inner circumference of the face panel 11 by engaging a stud pin 13 fixed on an inner circumference of the face panel 11 with a hookspring 15 welded outside the mask frame 9.

The mask frame 9 must have mechanical intensity enough to support the shadow mask 1 at tightly strained state.

The mechanical intensity of the mask frame 9 increases in proportion to the thickness, however, since the weight becomes heavy when the thickness is thickened, a bead 19 is generally used to obtain the maximum mechanical intensity with maintaining the minimum thickness.

In addition, the bead 19 is a portion to which the skirt portion 7 of the shadow mask 1 welded. For such a reason, the size of the shadow mask 1 is restricted not to increase the width of the useful screen portion 5 having apertures 3, and since the skirt portion 7 of the shadow mask 1 is spot welded to the bead 19 of the mask frame 9, the shadow mask 1 is easily vibrated to occur howling when the impact is applied from outside.

In such a structure that the shadow mask 1 is easily resonated, the deterioration of the image is not avoidable since the large-sized cathode ray tube recently manufactured has a high-power speaker.

In another aspect, as shown in FIG. 5, a burring 21 is formed on an open end portion of the mask frame 9 to enlarge the area welded to the shadow mask 1 with maintaining the mechanical intensity.

However, since the burring 21 is outwardly bent from the open end portion of the mask frame 9, the burring 21 is obstructed by the stud pin 13 when mounting the mask frame 9 inside the face panel 11.

To avoid the interference between the stud pin 13 and the burring 21, the size of the mask frame 9 is restricted to reduce the useful screen of the shadow mask 1.

SUMMARY OF THE INVENTION

Accordingly, the present invention is directed to a shadow mask frame assembly that substantially obviates one or more of the problems due to limitations and disadvantages of the related art.

An object of the present invention is to provide a shadow mask frame assembly for preventing the interference between a stud pin of a face panel and a burring. The burring used for the present invention reinforced the mechanical intensity of a mask frame, and the mask frame assembly is easily assembled.

Another object of the present invention is to provide a shadow mask frame assembly having high forming characteristics of a shadow mask, preventing the howling, and enlarging the useful screen portion.

To achieve these and other advantages in accordance with the purpose of the present invention, as embodied and broadly described, there is disclosed a shadow mask frame assembly for a cathode ray tube comprising a burring formed on an open end portion of a mask frame to increase the mechanical intensity.

At this point, a predetermined portion of the burring is cut to prevent the interference between a stud pin fixed on an inner circumference of the face panel and the burring.

In addition, according to the present invention, the mask frame comprises planar perpendicular portions parallel to an axial direction of the cathode ray tube to which a border of a skirt portion of the shadow mask is welded.

Further, according to the present invention, the skirt portion of the shadow mask comprises seven notches at least uniformly spaced from each other on its long side and five notches at least on its short side.

According to the present invention, since the mechanical intensity of the entire mask frame is uniformly reinforced by the burring, the thickness of the mask frame can be considerably reduced to decrease the weight of the mask frame, and since the shadow mask is directly welded to the planar perpendicular portion of the mask frame to enlarge the useful screen, a shadow mask frame assembly can be used for both 15-inched cathode ray tube and 17-inched cathode ray tube by simple operation such as change of a position of a hookspring to unify their parts, and since the shadow mask can be stably welded inside the mask frame, the howling can be prevented.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF PREFERRED EMBODIMENT

Figure 1:
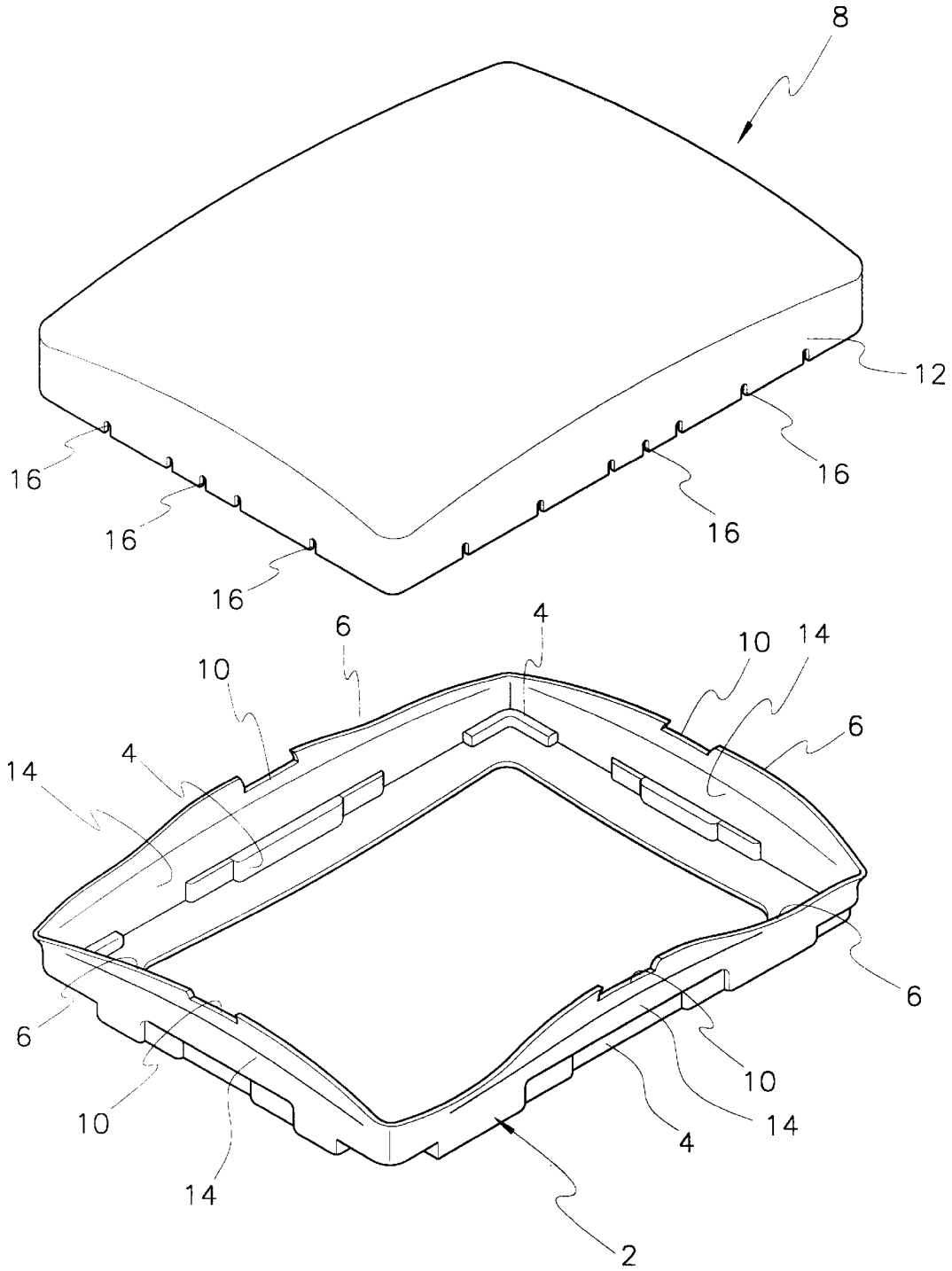
FIG. 1 is an exploded perspective view showing a structure of a main part of a present invention.

Reference will now be made in detail to the preferred embodiments of the present invention, examples of which are illustrated in the accompanying drawings.

Like reference numerals denote like reference parts throughout the specification and drawings.

FIG. 1 is an exploded perspective view showing a structure of a main part of a present invention.

In FIG. 1, the mask frame 2 comprises a bead 4 or a burring 6 in every predetermined position to considerably reinforce the mechanical intensity.

A middle portion of the burring 6 is partially cut to form a groove portion 10.

A shadow mask 8 is welded on the mask frame 2 to position a skirt portion 12 formed by approximately perpendicularly bending a border of the shadow mask 8 inside the mask frame 2.

The lower part of the burring 6 of the mask frame 2 forms a planar perpendicular portion 14 parallel to an axial direction of the cathode ray tube. Due to the planar perpendicular portion 14, not only the area welded to the shadow mask 8 but also the useful screen of a screen can be enlarged.

On the other hand, since the entire skirt portion 12 is supported by being contacted to the perpendicular portion 14 of the mask frame 2, the howling due to the vibration from the outside is prevented not to deteriorate the image.

The skirt portion 12 of the shadow mask 8 comprises seven notches 16 at least on its long side and five notches 16 at least on its short side to prevent the cohesion generated when extruding.

Preferably, three of the notches 16 are disposed on each middle part of the long side and the short side, and the rest of them are equally distributed on both side parts of the long and short sides.

Corners of each notch 16 must be rounded and the notches 16 adjacent to the end portions are preferably formed more deeply than others.

The notch 16 is to disperse the cohesion force generated when extruding the skirt portion 12 not to form wrinkles.

Figure 2:
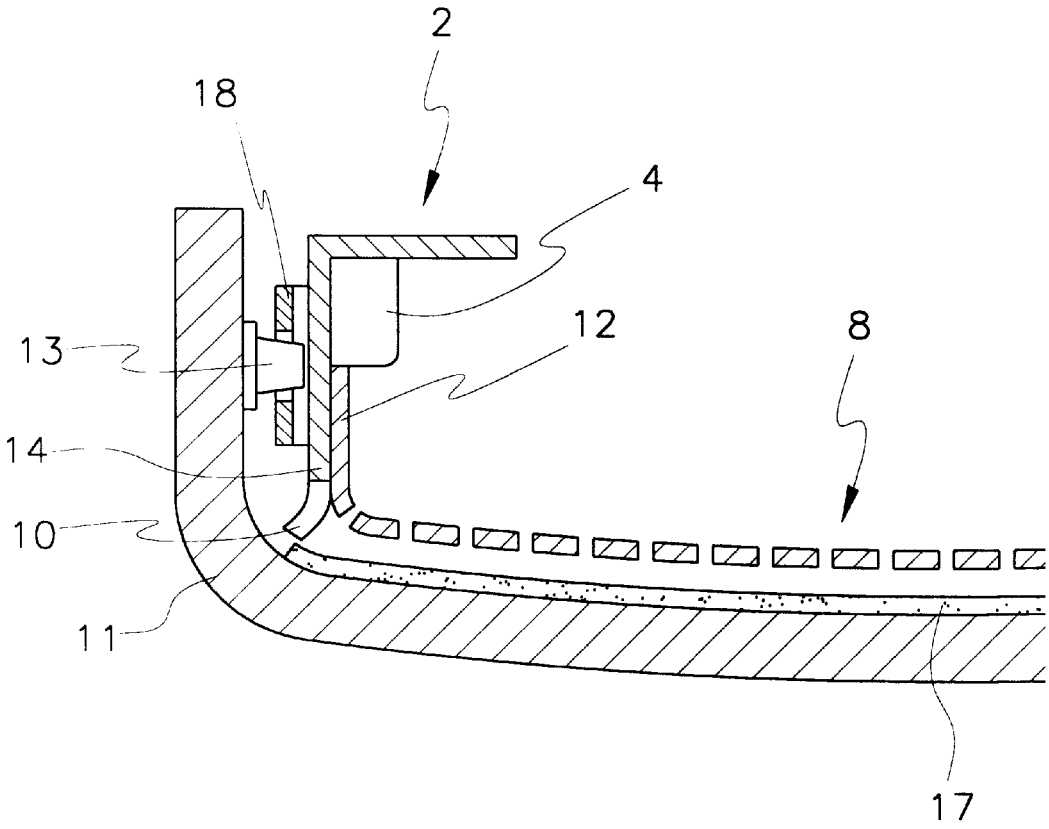
FIG. 2 is a side sectional view of a cathode ray tube employing the inventive mask frame assembly.
Figure 3:
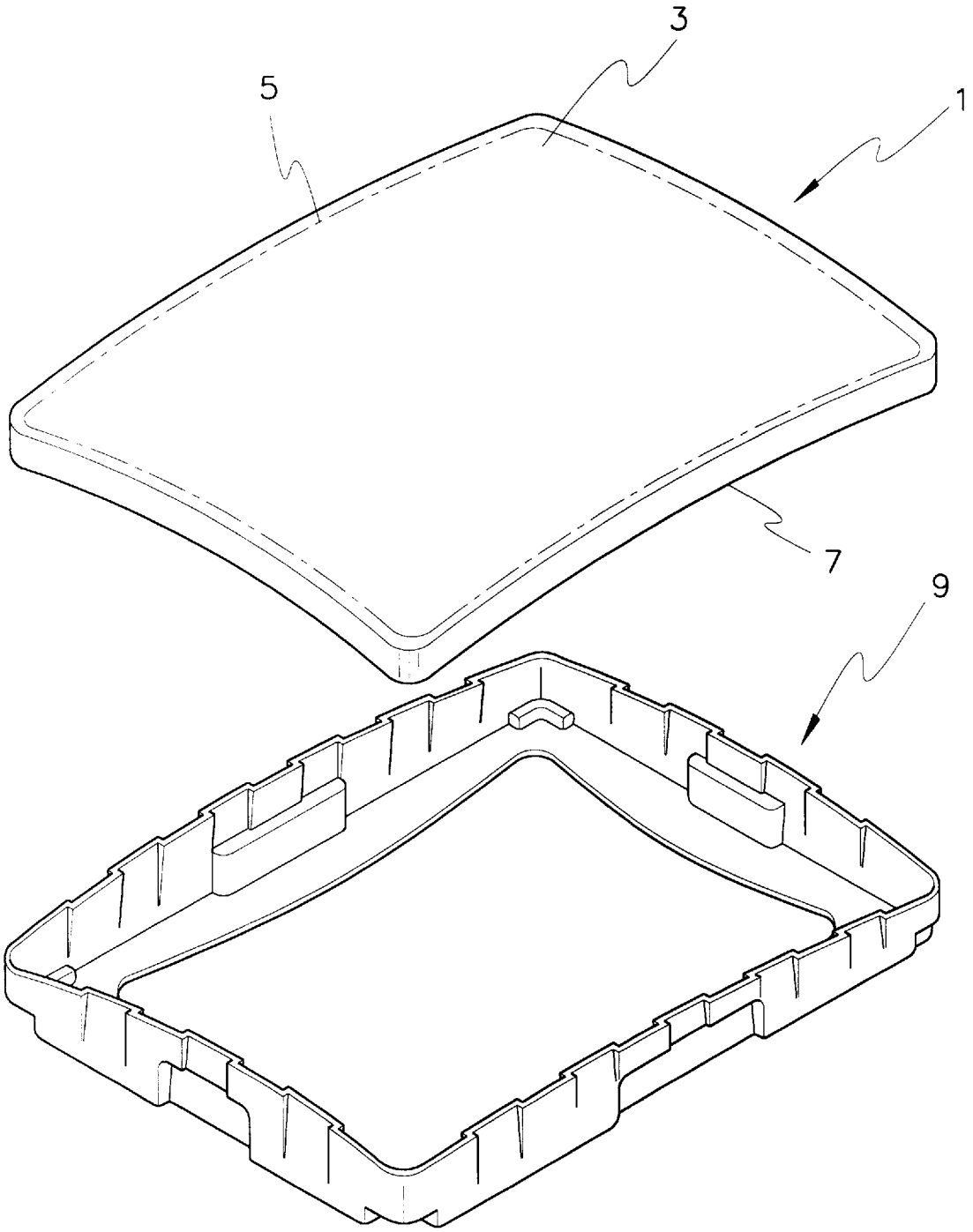
Fig. 3 (Prior Art)
FIG. 3 is an exploded perspective view of a conventional mask frame assembly.
Figure 4:
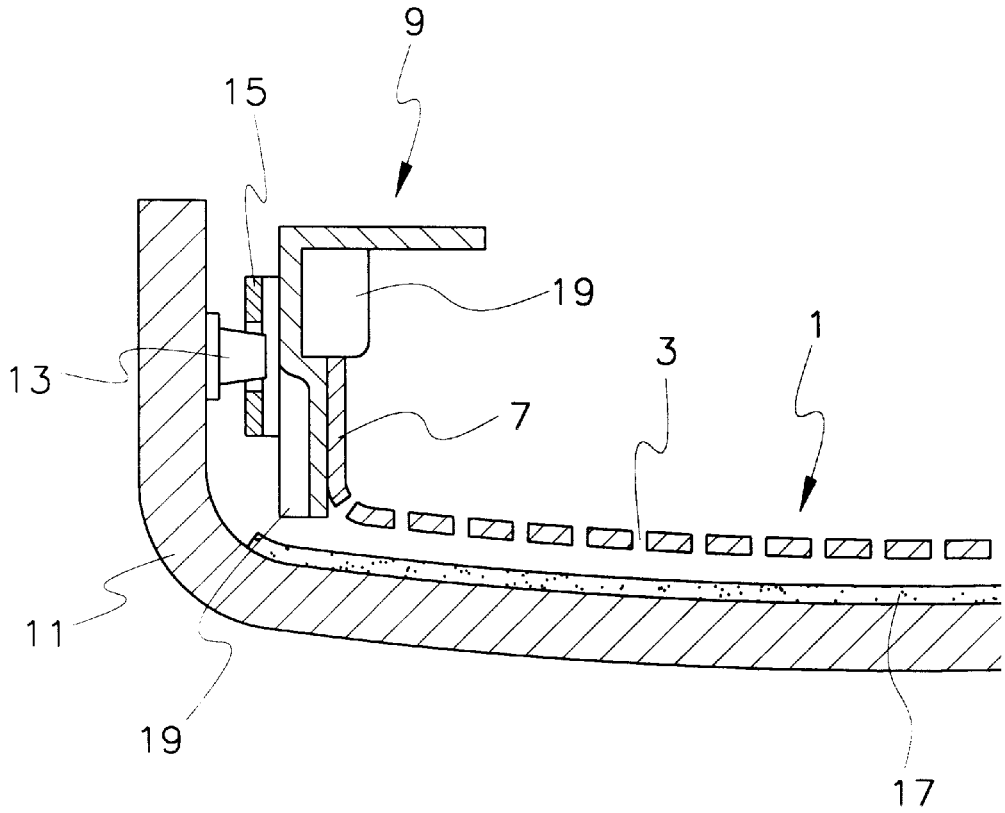
Fig. 4 (Prior Art)
FIG. 4 is a side sectional view of a cathode ray tube employing the conventional mask frame assembly shown in FIG. 3.
Figure 5:
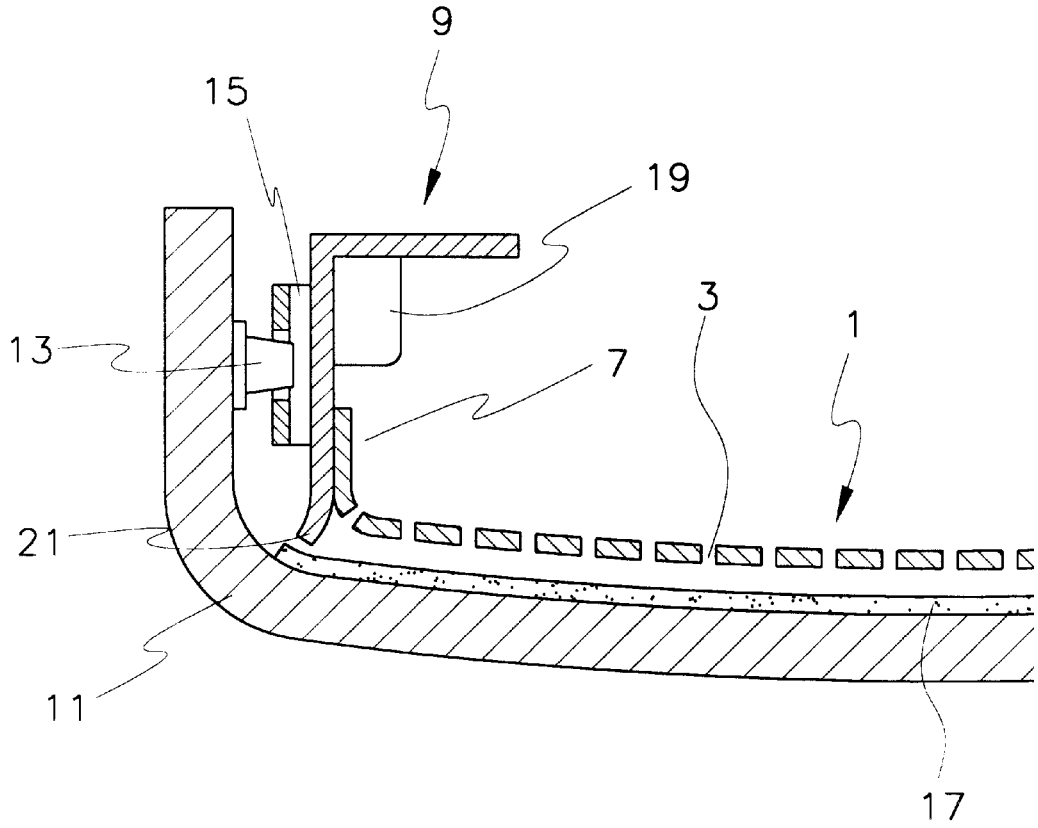
Fig. 5 (Prior Art)
FIG. 5 is a side sectional view of a cathode ray tube employing another conventional mask frame assembly.

FIG. 2 is a side sectional view of a cathode ray tube in which the inventive mask frame assembly is mounted inside of the general face panel 11.

The mask frame 2 is inserted into the face panel 11 with the open end portion having the burring 6 in the lead and the hookspring 18 formed on the outer side of the mask frame 2 is engaged with the stud pin 13 to dispose the shadow mask 8 opposite to a phosphor layer 17 of the face panel 11.

At this point, since the groove portion 10 formed on the burring 6 of the mask frame 2 crosses with the stud pin 13 fixed on the inner circumference of the face panel 11, the mask frame 2 can be inserted into the face panel 11 without interference between the burring 6 and the stud pin 13.

According to the present invention, it is possible to enlarge the useful screen of the shadow mask 8 to the maximum.

In addition, it is possible to lighten the mask frame 2 by reducing its entire thickness since the mechanical intensity of the open end portion of the mask frame 2 is reinforced by the burring 6.

Further, according to the present invention, the shadow mask 8 can be prevented from damage when assembling since the burring 6 is used as a guard of the shadow mask 2 as well.

The following table 1 shows the comparison of the inventive cathode ray tube with the others in the aspect of the useful screen area. The measuring unit is millimeter.

TABLE 1

| Kinds | Horizontal Width | Vertical Width | Diagonal Length |
|---|---|---|---|
| Present Invention | 332.5 | 250.2 | 411.6 |
| Samsung Display Device | 326.0 | 243.5 | 404.5 |
| Mathusita | 328.1 | 246.1 | 408.7 |
| Toshiba | 324.6 | 242.9 | 403.8 |
| Hitachi | 330.5 | 247.5 | 408.0 |

According to the present invention, the burring formed by bending the open end portion of the mask frame improves the mechanical intensity of the mask frame to reduce the thickness of the mask frame, and it results to lighten the mask frame.

Further, since the burring comprises the groove portion, the mask frame assembly is easily mounted inside the face panel without interference between the stud pin and the burring.

Further, since the shadow mask is directly welded to the planar perpendicular portion of the mask frame to enlarge the useful screen, a shadow mask frame assembly can be used for both 15-inched cathode ray tube and 17-inched cathode ray tube, and it enables to unify their parts, and since the entire skirt portion is supported by being contacted to the perpendicular portion of the mask frame, the howling can be prevented.

It will be apparent to those skilled in the art that various modifications and variations can be made in the shadow mask frame assembly of the present invention without departing from the spirit or scope of the invention.

Thus, it is intended that the present invention cover the modifications and variations of this invention provided they come within the scope of the appended claims and their equivalents.

What is claimed is:

1. A shadow mask frame assembly for a cathode ray tube comprising:

a burring outwardly bent from an open end portion of the mask frame into which a shadow mask is inserted;

groove portions formed on predetermined positions of said burring, for preventing interference between a stud pin fixed on a face panel and said burring.

2. A shadow mask frame assembly for a cathode ray tube according to claim 1, wherein a lower portion of the burring of said mask frame forms a planar perpendicular portion parallel to an axial direction of the cathode ray tube, to which a skirt portion of the shadow mask is welded.

3. A shadow mask frame assembly for a cathode ray tube according to claim 1, wherein the skirt portion of said shadow mask comprises a number of notches.

4. A shadow mask frame assembly for a cathode ray tube according to claim 3, wherein seven of said notches are disposed on each long side of the skirt portion and five of them on each short side thereof.

5. A shadow mask frame assembly for a cathode ray tube according to claim 4, wherein three of said notches are disposed on each middle part of the long side and the short side, and the rest of them are equally distributed on both side parts of the long and short sides.

6. A shadow mask frame assembly for a cathode ray tube according to claim 3, 4, or 5, wherein corners of each notch is rounded.

* * * * *